US007334836B2

(12) United States Patent
Chen

(10) Patent No.: US 7,334,836 B2
(45) Date of Patent: Feb. 26, 2008

(54) FOLDABLE CHAIR

(75) Inventor: Shun-Min Chen, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 11/527,943

(22) Filed: Sep. 26, 2006

(65) Prior Publication Data

US 2007/0194609 A1 Aug. 23, 2007

(30) Foreign Application Priority Data

Feb. 21, 2006 (CN) ..... 2006 2 0002376

(51) Int. Cl.
*A47D 1/02* (2006.01)
*A47B 83/02* (2006.01)
*A47C 4/00* (2006.01)

(52) U.S. Cl. ..... 297/16.1; 297/16.2; 297/24; 297/25; 297/38; 297/148; 297/150; 297/154

(58) Field of Classification Search ..... 297/148, 297/150, 154, 16.1, 16.2, 24, 25, 38
See application file for complete search history.

(56) References Cited

U.S. PATENT DOCUMENTS

| | | | | | |
|---|---|---|---|---|---|
| 69,145 | A * | 9/1867 | Vaill | 297/38 |
| 181,143 | A * | 8/1876 | Cogger | 297/38 |
| 404,589 | A * | 6/1889 | Batt | 297/38 X |
| 707,884 | A * | 8/1902 | Watson | 297/38 X |
| 2,571,463 | A * | 10/1951 | Lorenz | 297/38 X |
| 2,710,645 | A * | 6/1955 | Luckhardt | 297/38 |
| 3,345,105 | A * | 10/1967 | Levy et al. | 297/24 |
| 5,165,755 | A * | 11/1992 | Rho | 297/25 X |
| 5,707,104 | A * | 1/1998 | Perego | 297/16.1 |
| 5,820,207 | A * | 10/1998 | Wang | 297/148 X |
| 6,126,236 | A * | 10/2000 | Wu | 297/148 X |
| 6,129,414 | A * | 10/2000 | Brevi | 297/16.1 |
| 6,161,898 | A * | 12/2000 | Brevi | 297/150 X |
| 6,347,830 | B1 * | 2/2002 | Chen | 297/16.1 |
| 6,454,348 | B1 * | 9/2002 | Wu | 297/16.2 |
| 6,601,912 | B1 * | 8/2003 | Chen | 297/38 X |
| 6,692,068 | B1 * | 2/2004 | Tang | 297/16.2 |
| 6,736,450 | B2 * | 5/2004 | Miyagi | 297/16.2 |
| 6,854,800 | B2 * | 2/2005 | Perego | 297/148 |
| 6,877,801 | B2 * | 4/2005 | Asbach et al. | 297/16.1 |
| 7,029,064 | B2 * | 4/2006 | Chen | 297/16.1 |
| 2005/0248186 | A1 * | 11/2005 | Wang | 297/148 |
| 2006/0125293 | A1 * | 6/2006 | Yeh | 297/16.1 |
| 2007/0029845 | A1 * | 2/2007 | Riedl et al. | 297/16.1 |
| 2007/0040420 | A1 * | 2/2007 | Li | 297/148 |

* cited by examiner

*Primary Examiner*—Rodney B. White
(74) *Attorney, Agent, or Firm*—Darby & Darby P.C.

(57) ABSTRACT

A foldable chair includes a rear leg connected pivotally to a front leg, a carrier frame retained pivotally on the rear leg, a locking seat provided on the front leg and formed with first and second engaging portions, and a slide member mounted to a front arm part of the carrier frame and movable to selectively engage and disengage the first and second engaging portions. The slide member engages the first engaging portion to lock the carrier frame to the front leg for holding the foldable chair at an unfolded state. The slide member is disengaged from the first engaging portion so as to permit pivoting movement of the carrier frame and the front and rear legs for disposing the foldable chair at a folded state, and engages the second engaging portion when the foldable chair is disposed at the folded state.

17 Claims, 7 Drawing Sheets

FOLDABLE CHAIR

CROSS-REFERENCE TO RELATED APPLICATION

This application claims priority of Chinese Application No. 200620002376.7, filed on Feb. 21, 2006.

BACKGROUND OF THE INVENTION

1. Field of the Invention

The invention relates to a chair, more particularly to a foldable chair.

2. Description of the Related Art

A chair, such as a highchair used when feeding a child, is usually provided with a foldable mechanism to facilitate transport or storage. Referring to FIG. 1, a conventional highchair 1 includes front and rear legs 11, 12, a foldable link unit 13 bridging lower ends of the front and rear legs 11, 12, a pedal 14 connected to the link unit 13 and operable by foot to fold the link unit 13, and a locking mechanism 15 provided on pivotally connected upper ends of the front and rear legs 11, 12. To fold the highchair 1, both hands of the user must be used to unlock the locking mechanism 15, and the user must step on the pedal 14 to fold the link unit 13, followed by pushing of the front and rear legs 11, 12 and a seat 16 to complete the folding operation.

However, since components of the foldable mechanism, i.e., the link unit 13 and the pedal 14, are disposed at lower ends of the front and rear legs 11, 12, the construction as such is not only relatively complicated, but the weight of the highchair 1 is increased as well, which results in inconvenience during transport. Moreover, in view of the need to unlock the locking mechanism 15 using both hands, to step on the pedal 14 using one foot, and to push the front and rear legs 11, 12 and the seat 16, folding of the highchair 1 is inconvenient to conduct. Furthermore, there is a need to move the seat 16 manually on the front leg 11 so as to reduce the height of the highchair 1 after the latter is folded.

SUMMARY OF THE INVENTION

Therefore, the main object of the present invention is to provide a chair that can be folded conveniently and with relative ease.

Another object of the present invention is to provide a chair that can be folded and unfolded quickly using one hand to operate an actuator, and that can be retained at a selected one of folded and unfolded states.

Yet another object of the present invention is to provide a chair that has a relatively small size when folded.

A further object of the present invention is to provide a foldable chair, the height of which is reduced simultaneous with a folding operation of the chair.

According to one aspect of the present invention, a foldable chair comprises a front leg, a rear leg connected pivotally to the front leg, a carrier frame retained pivotally on the rear leg and having a front arm part, and a chair folding mechanism. The chair folding mechanism includes a locking seat provided on the front leg and formed with a first engaging portion and a second engaging portion, a slide member mounted to the front arm part of the carrier frame and movable to selectively engage and disengage the first and second engaging portions of the locking seat, and a biasing member provided on the slide member and accumulating a biasing force when the slide member is moved to disengage the first and second engaging portions of the locking seat. The slide member engages the first engaging portion of the locking seat so as to lock the carrier frame to the front leg for holding the foldable chair at an unfolded state. The slide member is disengaged from the first engaging portion of the locking seat so as to permit relative pivoting movement among the carrier frame, the front leg and the rear leg for disposing the foldable chair at a folded state. The slide member is moved to the second engaging portion of the locking seat, and is biased by the biasing member to engage the second engaging portion when the foldable chair is disposed at the folded state.

According to another aspect of the present invention, a foldable chair comprises a front leg having a locking seat provided slidably therealong, a rear leg connected pivotally to the front leg, a carrier frame pivoted to the rear leg, extending into the locking seat, and capable of being positioned at a selected one of first and second frame positions relative to the locking seat, and a support frame coupled to the locking seat. When the carrier frame is moved from the first frame position to the second frame position, the carrier frame moves the locking seat and the support frame downwardly along the front leg.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
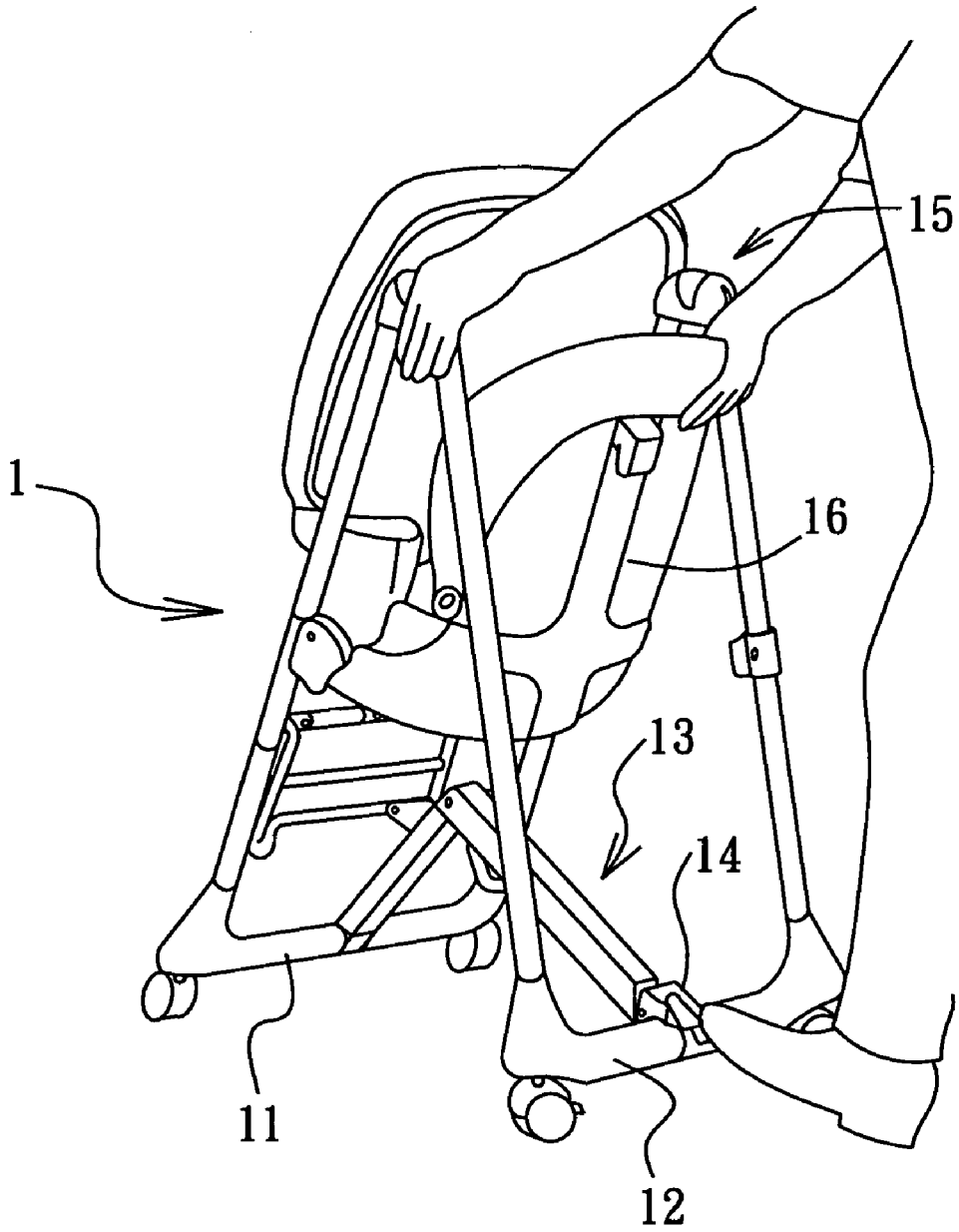
F I G. 1 PRIOR ART
FIG. 1 illustrates a conventional foldable highchair.
Figure 2:
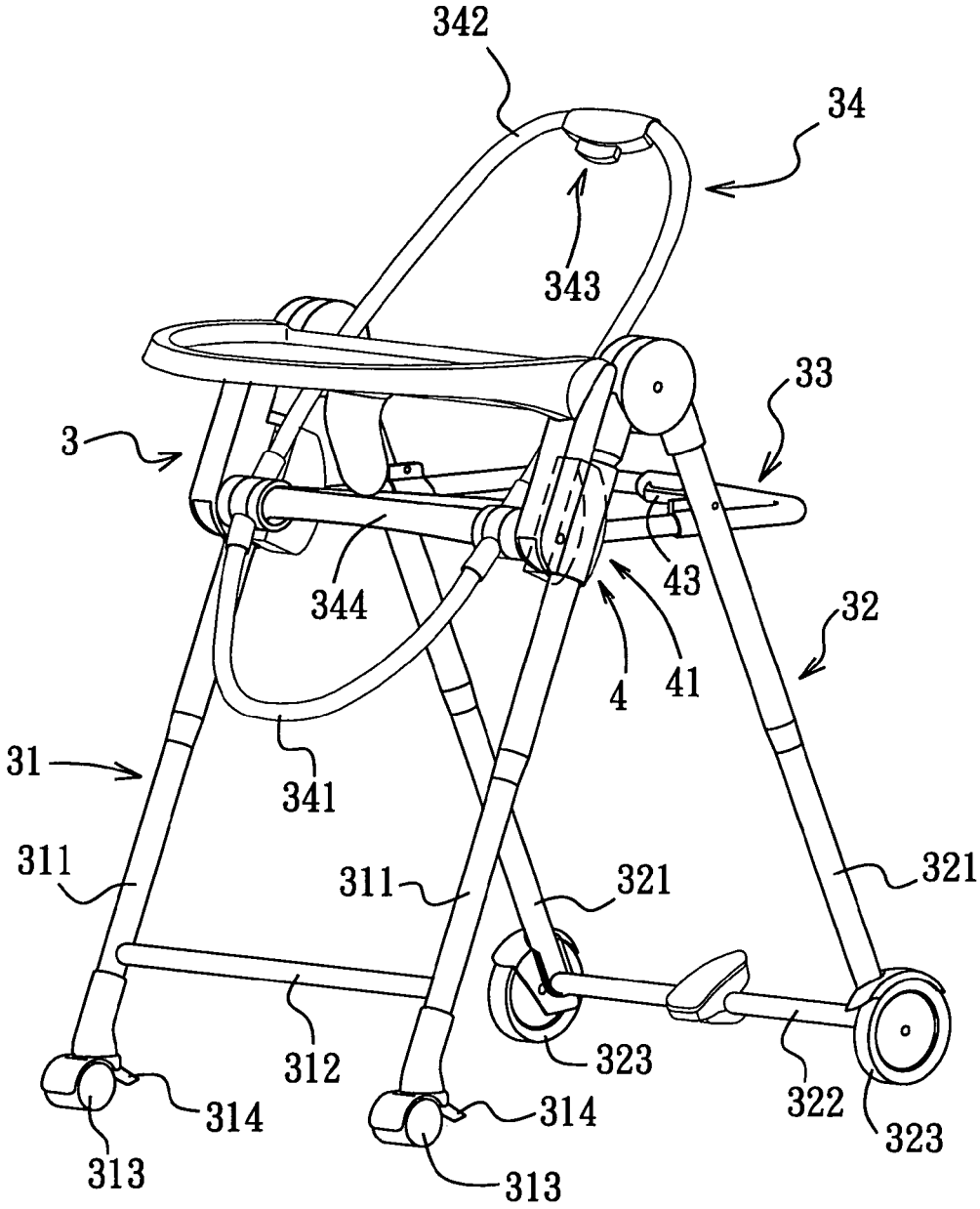
FIG. 2 is an assembled perspective view of the preferred embodiment of a foldable chair according to the present invention.
Figure 3:
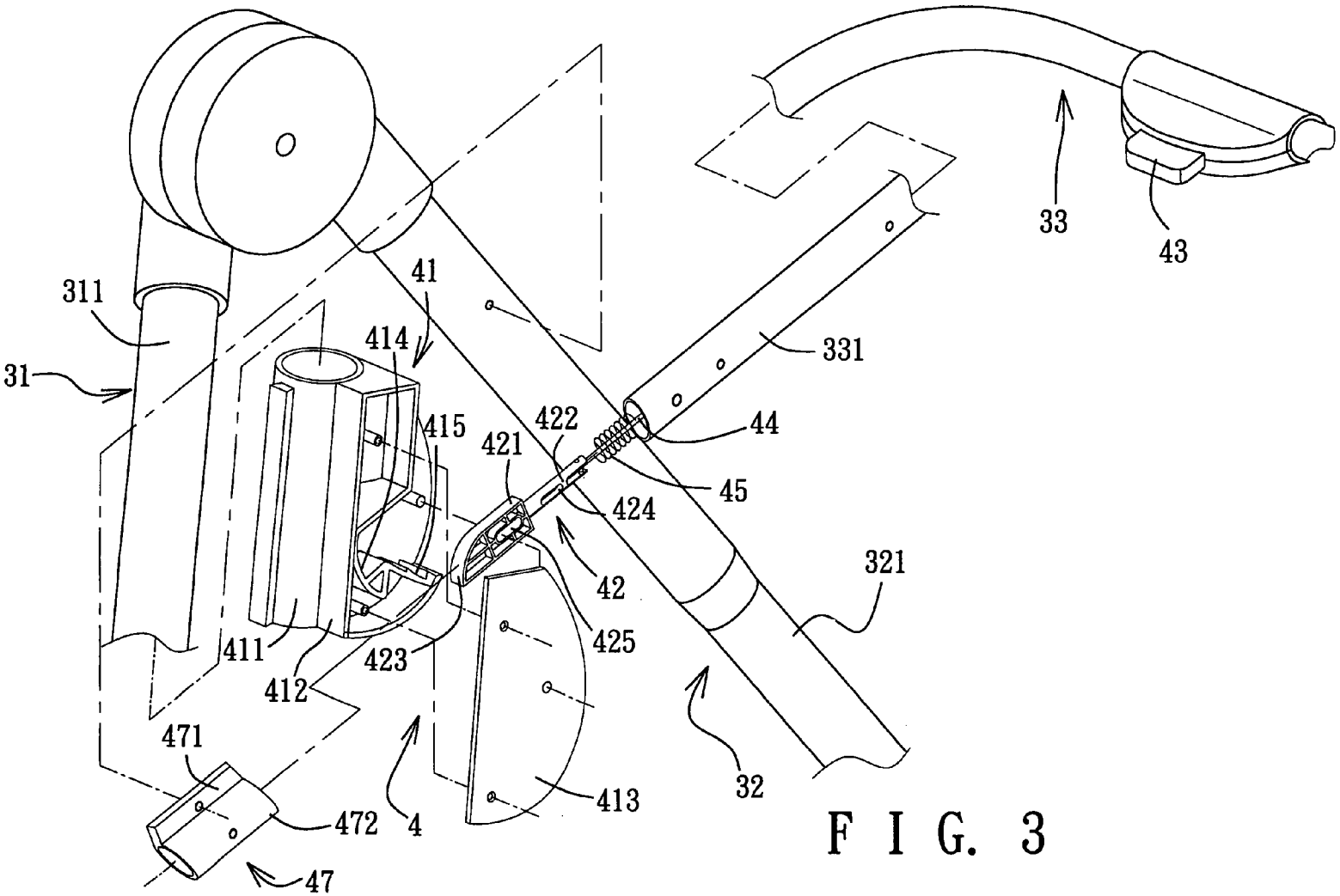
FIG. 3 is a fragmentary exploded perspective view of the preferred embodiment.
Figure 4:
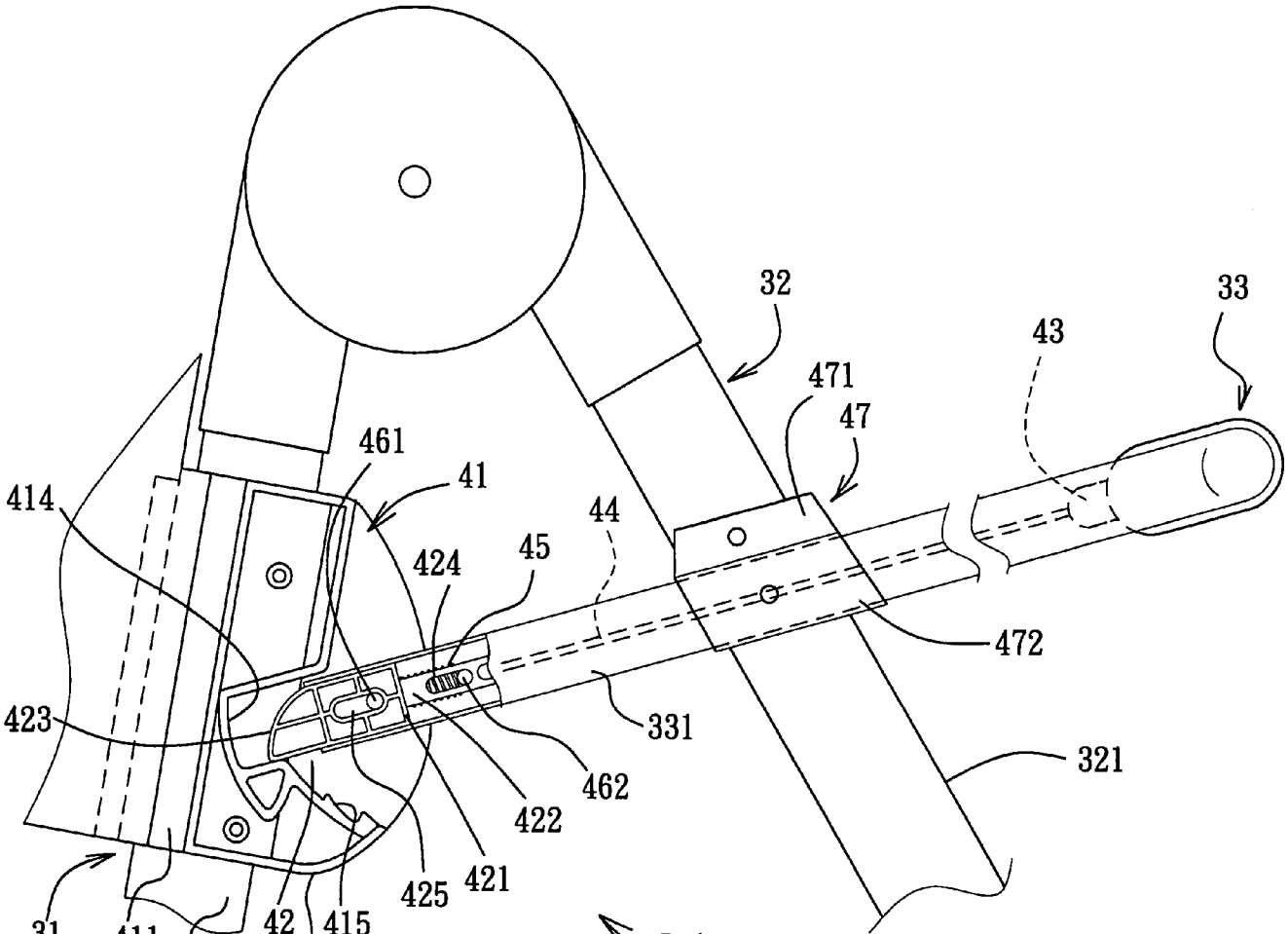
FIGS. 4 to 6 are fragmentary schematic views to illustrate how the preferred embodiment is converted from an unfolded state to a folded state.

Referring to FIG. 2, the preferred embodiment of a foldable chair 3 according to the present invention is shown to comprise a front leg 31, a rear leg 32, a carrier frame 33, a support frame 34, and a chair folding mechanism 4 (best shown in FIGS. 3 and 4). Since the improvement of this invention is directed to the overall framework of the foldable chair 3, a seat and a basket installed on the support frame 34 and the carrier frame 33 are omitted in the drawings for the sake of clarity.

Each of the front and rear legs 31, 32 includes a pair of upright rods 311, 321, a horizontal rod 312, 322 connected to and extending between the upright rods 311, 321, and wheels 313, 323 provided respectively on bottom ends of the upright rods 311, 321. The wheels 313 are provided with brakes 314 that are operable to pivot upwardly and downwardly. When the brakes 314 are pivoted downwardly, the brakes 314 contact the wheels 313 to stop rotation of the same, thereby arresting movement of the chair 3 on the ground. On the other hand, when the brakes 314 are pivoted upwardly, the brakes 314 cease to contact the wheels 313 to permit rotation of the same, thereby permitting movement of the chair 3 on the ground. Moreover, the front and rear legs 31, 32 have upper ends that are connected pivotally to each other such that the front and rear legs 31, 32 form an angle therebetween when the foldable chair 3 is disposed at an unfolded state (see FIGS. 2 and 4), and such that the front and rear legs 31, 32 are brought close together and are generally parallel to each other when the foldable chair 3 is disposed at a folded state (see FIGS. 6 and 7).

The carrier frame 33 is a U-shaped tubular member in this embodiment, is disposed between the upright rods 311, 321 of the front and rear legs 31, 32, is retained pivotally on the rear leg 32, and has a pair of front arm parts 331 (only one is shown in FIGS. 3 and 4). The carrier frame 33 is used for mounting a basket (not shown) thereon. The support frame 34 is coupled to locking seats 41 (to be described in detail hereinafter) on the upright rods 311 of the front leg 31, and includes a footrest frame part 341 for supporting the legs of a child who is seated on the chair 3, a backrest frame part 342 for mounting a backrest cushion or fabric (not shown), an adjustment mechanism 343 provided on the backrest frame part 342 and operable to adjust inclination of the backrest frame part 342, and a seat frame part 344 disposed between the footrest frame part 341 and the backrest frame part 342 for mounting a seat cushion or fabric (not shown). Since the feature of this invention does not reside in the specific construction of the adjustment mechanism 343, which is known in the art, further details of the same will be omitted herein for the sake of brevity.

As shown in FIGS. 3 and 4, the chair folding mechanism 4 includes a pair of locking seats 41 (only one is shown) provided respectively on the upright rods 311 of the front leg 31, a pair of slide members 42 (only one is shown) mounted respectively to the front arm parts 331 of the carrier frame 33, an actuator 43 provided on the carrier frame 33, a transmission member 44 that extends into the carrier frame 33, that is connected to the actuator 43, and that has opposite ends connected respectively to the slide members 42, and a pair of biasing members 45 associated operably and respectively with the slide members 42. Each locking seat 41 includes a sleeve portion 411 sleeved on and slidable along the respective upright rod 311 of the front leg 31, a seat body 412 extending from the sleeve portion 411 and having an open lateral side, and a cover 413 mounted to the seat body 412 for closing the open lateral side of the seat body 412. The seat body 412 is formed with a retaining notch 414 and a recessed region 415 that open toward the rear leg 32. The retaining notch 414 is upwardly inclined relative to the respective upright rod 311 of the front leg 31, and defines a first engaging portion of the locking seat 41. The recessed region 415 is disposed proximate to and below the retaining notch 414, and defines a second engaging portion of the locking seat 41. Each slide member 42 has a first section 421 with front and rear ends, and a second section 422 connected to the rear end of the first section 421 and reduced in cross-section with respect to the first section 421. The front end of the first section 421 of each slide member 42 is formed with a curved guide face 423. The first and second sections 421, 422 of each slide member 42 are formed with first and second guide slots 425, 424 therealong, respectively. Each slide member 42 extends movably into the respective front arm part 331 of the carrier frame 33. The carrier frame 33 further has two sets of first and second pins 461, 462 (only one set is shown in FIG. 4) that extend through a respective front arm part 331 of the carrier frame 33 and a corresponding one of the first and second guide slots 425, 424 in a respective slide member 42 to guide movement of the respective slide member 42 in the respective front arm part 331. Each of the first pins 461 is secured to a respective one of the locking seats 41 at one end.

In this embodiment, the actuator 43 is a manually operable push button, and the transmission member 44 is a steel cable. In addition, each biasing member 45 includes a coil spring sleeved on the second section 422 of the respective slide member 42 and having opposite ends that abut respectively against the first section 421 of the respective slide member 42 and one of the second pins 462. Each biasing member 45 accumulates a biasing force when the respective slide member 42 is moved to disengage the first and second engaging portions of the respective locking seat 41.

The chair folding mechanism 4 further includes a pair of retaining members 47 (only one is shown in FIGS. 3 and 4). Each retaining member 47 has a securing portion 471 mounted pivotally on a respective upright rod 321 of the rear leg 32, and a connecting portion 472 extending from the securing portion 471 and permitting extension of a respective front arm part 331 of the carrier frame 33 therethrough. Through the retaining members 47, the carrier frame 33 can pivot relative to the rear leg 32 when converting the chair 3 between the unfolded and folded states. However, in other embodiments of the invention, the retaining members 47 may be omitted, and the carrier frame 33 may be pivoted directly to the upright rods 321 of the rear leg 32 with the use of rivets to achieve the same effect.

Referring to FIGS. 2 and 4, when the chair 3 is disposed at the unfolded state, the front and rear legs 31, 32 form an angle therebetween, the carrier frame 33 is at a first frame position (i.e., the carrier frame 33 is at a generally horizontal state), and the slide members 42 of the chair folding mechanism 4 extend into the retaining notches 414 in the locking seats 41, respectively, thereby locking the carrier frame 33 to the front leg 31 such that the carrier frame 33 and the front and rear legs 31, 32 form a firm triangular structure for holding the chair 3 at the unfolded state. The support frame 34 is at a highest position relative to the front leg 31 at this time.

Figure 5:
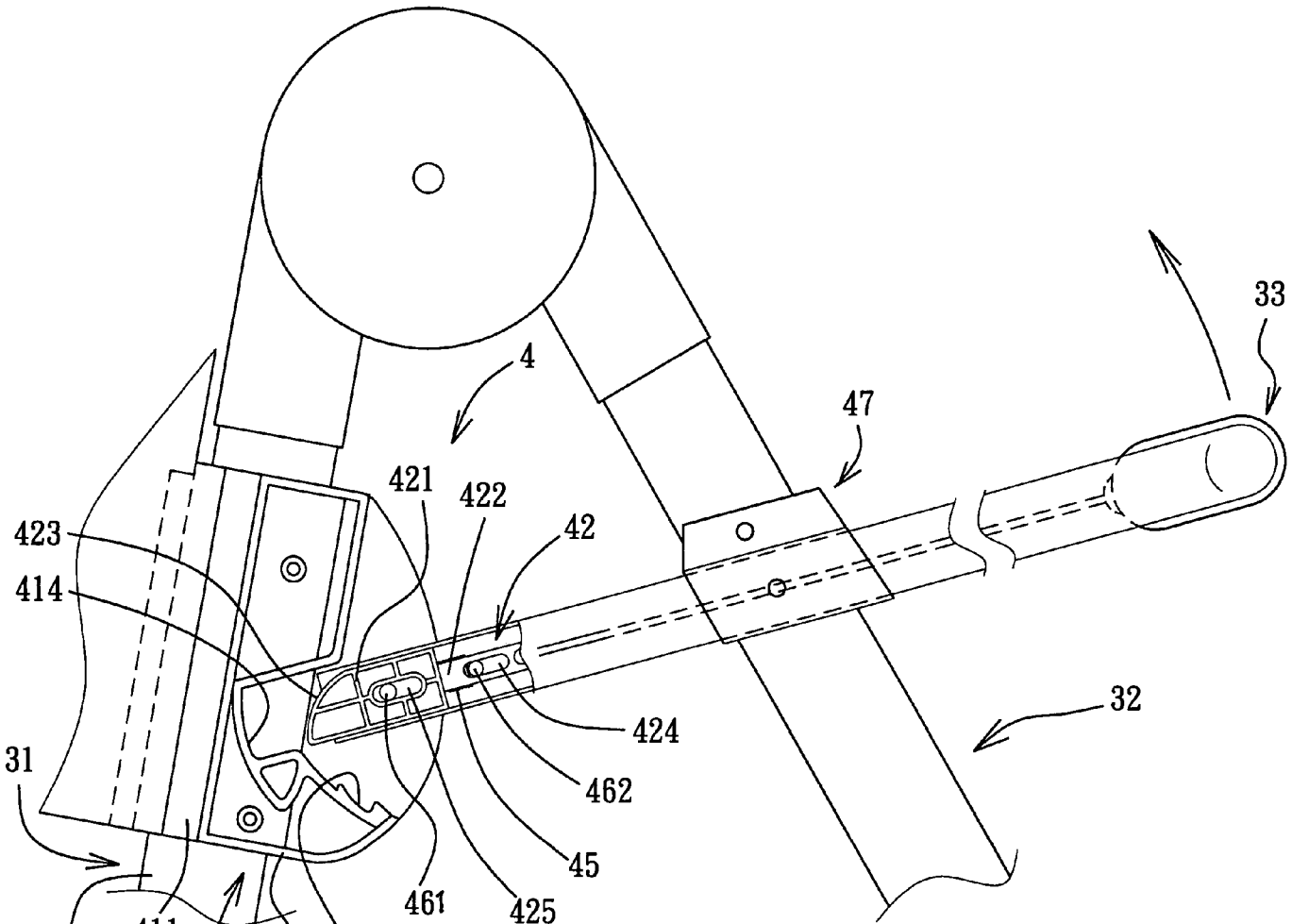
Figure 6:
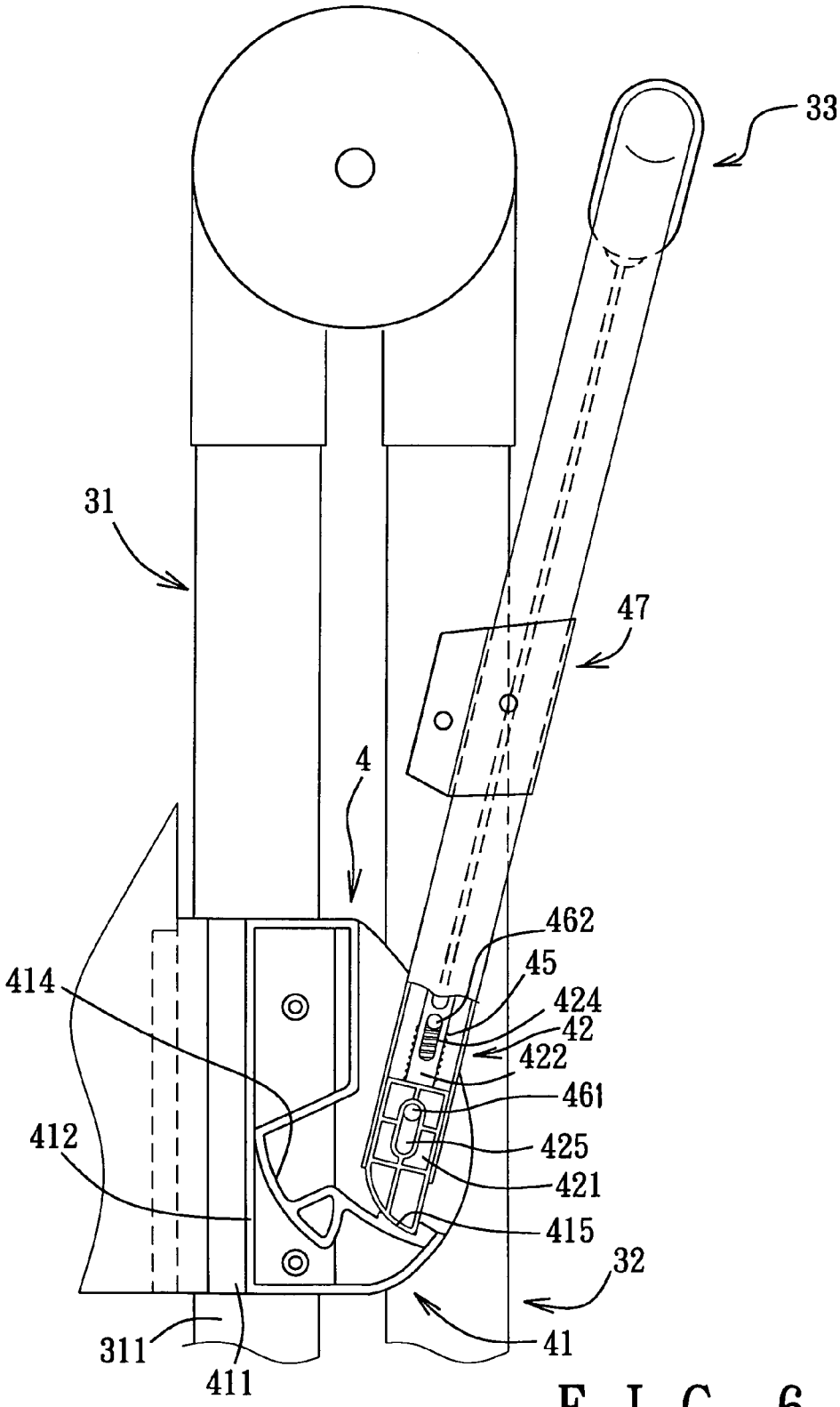
Figure 7:
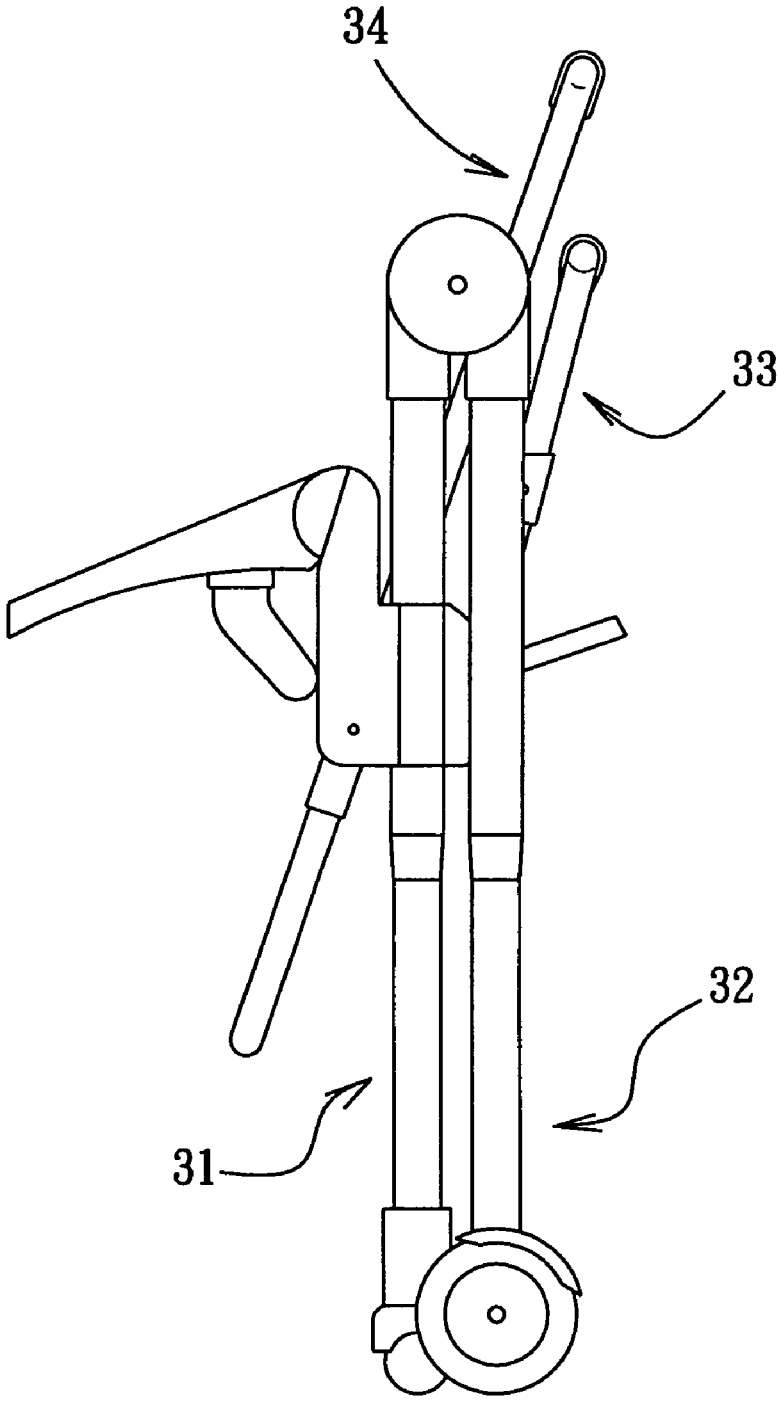
FIG. 7 is a schematic side view of the preferred embodiment when disposed at the folded state.

As shown in FIGS. 3, 4, and 5, when converting the foldable chair 3 from the unfolded state shown in FIG. 2 to the folded state, the actuator 43 is operated by one hand of the user to move the slide members 42 via the transmission member 44 so as to disengage the first sections 421 of the slide members 42 from the retaining notches 414 in the locking seats 41. The biasing members 45 accumulate a biasing force at this time, and the carrier frame 33 can be pushed forwardly toward the front leg 31 (see FIG. 5) so as to pivot the carrier frame 33 together with the retaining members 47 relative to the rear leg 32 and to result in relative pivoting movement among the carrier frame 33, the front leg 31 and the rear leg 32 for disposing the foldable chair 3 at the folded state shown in FIGS. 6 and 7. Since the locking seats 41 are provided slidably on the upright rods 311 of the front leg 31, since the support frame 34 is coupled to the locking seats 41, and since the retaining members 47 rotate with the carrier frame 33 relative to the rear leg 32 when the carrier frame 33 is pushed toward the front leg 31 during conversion of the chair 3 from the unfolded state to the folded state, the carrier frame 33 moves the locking seats 41 together with the support frame 34 downwardly along the upright rods 311 of the front leg 31 and is moved from the first frame position (i.e., a generally horizontal state as shown in FIG. 4) to a second frame position (i.e., the carrier frame 33 is at a generally upright state as best shown in FIG. 6) to result in a compact folded size for the chair 3. The support frame 34 is at a lowest position relative to the front leg 31 at this time. When the foldable chair 3 is disposed at the folded state, the first sections 421 of the slide members 42 are moved to the recessed regions 415 of the locking seats 41. Thereafter, when the actuator 43 is released, the first sections 421 of the slide members 42 extend into the recessed regions 415 of the locking seats 41 by virtue of the biasing action of the biasing members 45 to thereby retain releasably the chair 3 at the folded state. To unfold the chair 3, it is only required to apply a force on the carrier frame 33 to cause the curved guide faces 423 of the first sections 421 of the slide members 42 to move from the recessed regions 415 to the retaining notches 414 of the locking seats 41.

In sum, the foldable chair 3 of this invention can be easily folded and unfolded through single-handed operation of the actuator 43, which drives movement of the slide members 42 via the transmission member 44. In addition, because the carrier frame 33 is moved from a generally horizontal state to a generally upright state and because the support frame 34 is moved from a highest position to a lowest position when the chair 3 is folded, the chair 3 has a compact folded size.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable chair comprising:

a front leg;

a rear leg connected pivotally to said front leg;

a carrier frame retained pivotally on said rear leg and having a front arm part; and a chair folding mechanism including a locking seat provided on said front leg and formed with a first engaging portion and a second engaging portion, a slide member mounted to said front arm part of said carrier frame and movable to selectively engage and disengage said first and second engaging portions of said locking seat, and a biasing member provided on said slide member and accumulating a biasing force when said slide member is moved to disengage said first and second engaging portions of said locking seat;

said slide member engaging said first engaging portion of said locking seat so as to lock said carrier frame to said front leg for holding said foldable chair at an unfolded state;

said slide member being disengaged from said first engaging portion of said locking seat so as to permit relative pivoting movement among said carrier frame, said front leg and said rear leg for disposing said foldable chair at a folded state, said slide member being moved to said second engaging portion of said locking seat and being biased by said biasing member to engage said second engaging portion when said foldable chair is disposed at the folded state.

2. The foldable chair as claimed in claim 1, wherein said front and rear legs have upper ends connected pivotally to each other, said front and rear legs forming an angle therebetween when said foldable chair is disposed at the unfolded state, said front and rear legs being brought close together and being generally parallel to each other when said foldable chair is disposed at the folded state.

3. The foldable chair as claimed in claim 1, wherein said chair folding mechanism further includes a transmission member provided on said carrier frame and connected to said slide member, and an actuator provided on said carrier frame and connected to said transmission member, said actuator being operable to move said slide member via said transmission member so as to selectively disengage said first and second engaging portions of said locking seat.

4. The foldable chair as claimed in claim 1, wherein said locking seat includes:

a sleeve portion sleeved on said front leg; and a seat body extending from said sleeve portion and formed with a retaining notch and a recessed region that open toward said rear leg, said retaining notch being upwardly inclined relative to said front leg and defining said first engaging portion of said locking seat, said recessed region being disposed proximate to and below said retaining notch and defining said second engaging portion of said locking seat;

wherein said slide member extends into said retaining notch when said foldable chair is disposed at the unfolded state, and extends into said recessed region when said foldable chair is disposed at the folded state.

5. The foldable chair as claimed in claim 4, wherein said seat body has an open lateral side, and said locking seat further includes a cover mounted to said seat body for closing said open lateral side of said seat body.

6. The foldable chair as claimed in claim 4, wherein said slide member has a first section with front and rear ends, and a second section connected to said rear end of said first section, said front end of said first section of said slide member being formed with a curved guide face to guide movement of said first section of said slide member into and out of said retaining notch and said recessed region of said seat body.

7. The foldable chair as claimed in claim 6, wherein said front arm part of said carrier frame is tubular, said slide member extending movably into said front arm part, said first section of said slide member being formed with a first guide slot therealong, said carrier frame further having a first pin that extends through said front arm part and said first guide slot to guide movement of said slide member in said front arm part.

8. The foldable chair as claimed in claim 7, wherein said second section of said slide member is formed with a second guide slot therealong, said carrier frame further having a second pin that extends through said front arm part and said second guide slot, said biasing member including a coil spring sleeved on said second section of said slide member, said coil spring having opposite ends that abut respectively against said first section of said slide member and said second pin.

9. The foldable chair as claimed in claim 3, wherein said transmission member is a steel cable.

10. The foldable chair as claimed in claim 1, wherein said chair folding mechanism further includes a retaining member that has a securing portion mounted pivotally on said rear leg, and a connecting portion extending from said securing portion and permitting extension of said carrier frame therethrough.

11. A foldable chair comprising:

a front leg having a locking seat provided slidably therealong;

a rear leg connected pivotally to said front leg;

a carrier frame pivoted to said rear leg, extending into said locking seat, and capable of being positioned at a selected one of first and second frame positions relative to said locking seat; and a support frame coupled to said locking seat;

wherein, when said carrier frame is moved from said first frame position to said second frame position, said carrier frame moves said locking seat and said support frame downwardly along said front leg.

12. The foldable chair as claimed in claim 11, wherein said locking seat includes a sleeve portion sleeved on said front leg, and a seat body extending from said sleeve portion, said carrier frame extending into said seat body.

13. The foldable chair as claimed in claim 12, wherein said seat body has an open lateral side, and said locking seat further includes a cover mounted to said seat body for closing said open lateral side of said seat body.

14. The foldable chair as claimed in claim 11, wherein:

when said carrier frame is moved to the first frame position, said front leg and said rear leg are simultaneously pivoted relative to each other for disposing said foldable chair at an unfolded state, and when said carrier frame is moved from the first frame position to the second frame position, said front leg and said rear leg are simultaneously pivoted relative to each other for disposing said foldable chair at a folded state.

15. The foldable chair as claimed in claim 14, wherein said front and rear legs have upper ends connected pivotally to each other, said front and rear legs forming an angle therebetween when said foldable chair is disposed at the unfolded state, said front and rear legs being brought close together and being generally parallel to each other when said foldable chair is disposed at the folded state.

16. A foldable chair comprising:

a front leg having a locking seat provided slidably therealong;

a rear leg connected pivotally to said front leg at an upper end thereof and forming an angle with said front leg when said foldable chair is disposed at an unfolded state;

a carrier frame pivoted to said rear leg and provided with a slide member that extends into said locking seat and that is operable to position said carrier frame at a selected one of first and second frame positions relative to said locking seat; and an actuator coupled to said slide member and operable to release positioning action of said slide member on said carrier frame;

wherein, when said carrier frame is moved from said first frame position to said second frame position, said carrier frame moves said locking seat downwardly along said front leg, and the angle between said front leg and said rear leg is reduced by virtue of pivoting movement of said carrier frame relative to said rear leg.

17. The foldable chair as claimed in claim 16, further comprising a support frame coupled to said locking seat.

* * * * *